US006883280B2

(12) United States Patent
Hayes

(10) Patent No.: US 6,883,280 B2
(45) Date of Patent: Apr. 26, 2005

(54) INTEGRATED POST-TENSION ANCHOR

(76) Inventor: Norris Hayes, 1430 Florence Rd., Sugar Land, TX (US) 77478

( * ) Notice: Subject to any disclaimer, the term of this patent is extended or adjusted under 35 U.S.C. 154(b) by 141 days.

(21) Appl. No.: 10/357,127

(22) Filed: Feb. 3, 2003

(65) Prior Publication Data

US 2004/0148881 A1 Aug. 5, 2004

(51) Int. Cl.[7] ..... E04C 5/12
(52) U.S. Cl. ..... 52/223.13
(58) Field of Search ..... 52/223.13, 223.14

(56) References Cited

U.S. PATENT DOCUMENTS 4,719,658 A * 1/1988 Kriofske ..... 52/223.13
4,773,198 A * 9/1988 Reinhardt ..... 52/223.13
4,819,393 A * 4/1989 Augoyard ..... 52/223.13
4,821,474 A * 4/1989 Rodriguez ..... 52/223.13
4,896,470 A * 1/1990 Sorkin ..... 52/223.13
5,024,032 A * 6/1991 Rodriguez ..... 52/223.13
5,072,558 A * 12/1991 Sorkin et al. ..... 52/223.13
5,079,879 A * 1/1992 Rodriguez ..... 52/223.13
RE34,350 E * 8/1993 Dufossez ..... 52/223.13
5,263,291 A * 11/1993 Knight ..... 52/223.13
5,271,199 A * 12/1993 Northern ..... 52/223.13
5,440,842 A * 8/1995 Sorkin ..... 52/223.13
5,755,065 A * 5/1998 Sorkin ..... 52/223.13
5,839,235 A * 11/1998 Sorkin ..... 52/223.13
5,897,102 A * 4/1999 Sorkin ..... 52/223.13
6,023,894 A * 2/2000 Sorkin ..... 52/223.13
6,027,278 A * 2/2000 Sorkin ..... 52/223.13
6,354,596 B1 * 3/2002 Rodriguez ..... 52/223.13
6,381,912 B1 * 5/2002 Sorkin ..... 52/223.13
6,393,781 B1 * 5/2002 Sorkin ..... 52/223.13
6,631,596 B1 * 10/2003 Sorkin ..... 52/223.13
6,684,585 B2 * 2/2004 Campbell ..... 52/223.13
6,761,002 B1 * 7/2004 Sorkin ..... 52/223.13
2002/0178665 A1 * 12/2002 Campbell ..... 52/223.13

* cited by examiner

*Primary Examiner*—Rodney B. White
(74) *Attorney, Agent, or Firm*—Alan J. Atkinson; Richard A. Fagin

(57) ABSTRACT

An apparatus and method for reducing corrosion in post-tension construction is described. An anchor base having an aperture with at two continuously opening surfaces is used with a post-tension tendon. A sheath surrounds the anchor and includes a cylindrical extension having a contact end distal from the anchor base for contacting the tendon as the tendon is inserted through the cylindrical extension and the anchor base aperture. The method positions an anchor base in a selected location so that a tendon end can be inserted into the anchor base to engaged the contact end distal from the anchor base. The tendon is threaded through the anchor base until a selected length extends through the base. The tendon is tensioned, a segment of the tendon sleeve is removed proximate to the anchor base, and a wedge is anchored between the tendon and the anchor base.

7 Claims, 3 Drawing Sheets

INTEGRATED POST-TENSION ANCHOR

BACKGROUND OF THE INVENTION

The invention relates to the field of post tension systems for strengthening concrete. More particularly, the invention relates to an improved anchor and method for reducing corrosion on the wire strands of a post-tension tendon.

Mono-strand tendons typically comprise a seven wire strand cable or tendon placed within a plastic or elastomeric sheath. A seven wire tendon is formed with six wires helically wrapped around a central core wire.

Wire cable corrosion is a significant concern in post tension systems. Such corrosion occurs when water, salt and other corrosive agents contact the metallic tendon materials. Tendon failure typically occurs due to water intrusion into the interstices between the tendon and is typically concentrated at tendon ends or anchors.

Such failure also occurs at portions of the tendon damaged segments caused during installation. The installation of tendons typically occurs in a rugged construction environment where the tendons can be damaged by equipment, careless handling and contact with various site hazards. When the elastomeric sheath is punctured, a water leak path contacting the wire tendon is established. The puncture must be patched to resist water intrusion between the sheath and tendon. The puncture and patch can create a discontinuity between the tendon and the sheath, and this discontinuity can impede proper installation and performance of the tendon.

One conventional technique for providing extra protection in corrosive environments is to increase the thickness of the plastic sheath covering the tendon. A plastic sheath at least forty mils thick can be formed around the tendon resist abrasion and puncture damage. Although this approach provides incremental protection against leakage, a thicker sheath does not provide redundant protection to the tendon steel.

Another technique for providing extra protection in corrosive environments uses seals and grease-filled pockets for blocking water intrusion into the central tendon core. Oil or grease is pumped into the exposed tendon end to fill the interstices at the tendon ends, however this procedure does not protect the internal wire strands forming the tendon.

Another technique for resisting high corrosion environments specially coats or otherwise treats the individual wire strand with an electrostatic fusion-bonded epoxy to a thickness between one and five mils thick. Similar wire coating techniques use galvanized wire and other corrosion resistant wires within the multiple wire cables to form a corrosion resistant tendon. Significant effort has been made to create improved corrosion resistant materials compatible with the exterior sheaths and resistant to corrosion. Corrosion resistant materials typically have an affinity to metal and are capable of displacing air and water. Additionally, such materials are relatively free from tendon attacking contaminants such as chlorides, sulfides and nitrates. However, such tendons are expensive and the effectiveness of such corrosion resistant materials may not resist corrosion after the tendon is damaged.

Tendon corrosion typically occurs near the post-tension anchors because the outer sheath is removed from the wire tendon at such locations. To protect the bare wire from corrosion, protective tubes are connected to the anchor and are filled with grease or other corrosion preventative material. This conventional practice is demonstrated by different post-tension systems. For example, U.S. Pat. No. 5,271,199 to Northern (1993) disclosed tubular members and connecting caps for attachment to an anchor. U.S. Pat. No. 5,749,185 to Sorkin (1998) disclosed split tubular members for attachment to and anchor and for installation over the tendon. U.S. Pat. No. 5,897,102 to Sorkin (1999) disclosed a tubular member having a locking surface for improving the connection to an anchor, and a cup member and extension for engagement on the other side of the anchor. U.S. Pat. No. 6,027,278 to Sorkin (2000) and U.S. Pat. No. 6,023,894 to Sorkin (2000) also disclosed a tubular member having a locking surface to improve the connection to an anchor. U.S. Pat. No. 6,098,356 to Sorkin (2000) disclosed attachable tubular members filled with corrosion resistant grease.

A need exists for a improved post-tension system which resists corrosion and consequential failure of a post-tension structure. The system should be compatible with existing installation procedures and should resist the risk of water intrusion into contact with internal tendon wires.

SUMMARY OF THE INVENTION

The invention provides an apparatus and method for reducing corrosion in post-tension construction. The apparatus provides an anchor base having first and second sides and having an aperture oriented about a centerline for permitting insertion of the tendon therethrough, wherein the aperture has first and second surfaces each having a different shape relative to the aperture centerline, and wherein the first and second surfaces continuously enlarge the size of said aperture between the first and second sides of said anchor base.

In another embodiment of the invention, a sheath can be engaged with the anchor base and can include a cylindrical extension having a contact end distal from the anchor base for contacting the tendon as the tendon is inserted through the cylindrical extension and the anchor base aperture.

The method of the invention comprises the steps of positioning an anchor base in a selected location, wherein the anchor base has a shaped aperture for permitting insertion of the tendon therethrough and further has a sheath comprising a cylindrical extension having a contact end distal from the anchor base for contacting the tendon as the tendon is inserted through the cylindrical extension, of inserting an end of the tendon through the cylindrical extension distal end so that the distal end contacts the tendon, and of threading the tendon end through the anchor base aperture until a selected length of the tendon extends through the anchor base.

DESCRIPTION OF THE PREFERRED EMBODIMENTS

The invention provides a unique system for providing a post tension system resistant to corrosion. Each tendon typically comprises an exterior sheath surrounding at least two strands formed with a material such as carbon steel.

Figure 1:
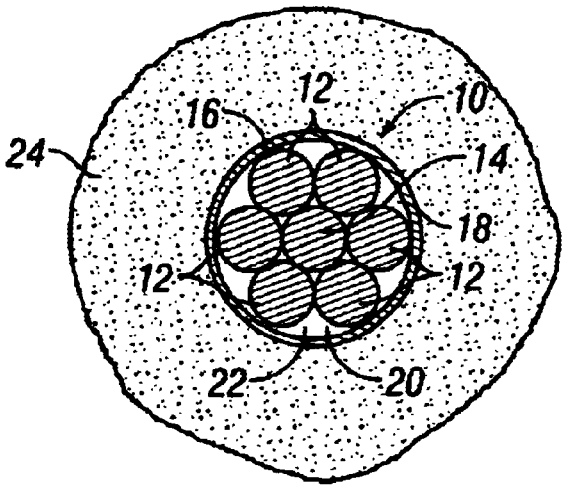
FIG. 1 illustrates a mono-strand cable enclosed with a first sheath.

FIG. 1 illustrates a sectional view wherein mono-strand wire tendon 10, formed with individual wire strands 12 about center wire 14, is positioned within first sheath 16. One or more wire strands 12 are helically wrapped about center wire strand 14 and form helical grooves on the exterior surface of cable 10. Such helical grooves are cumulatively identified as shaped annulus 18 defining the space between tendon 10 and the interior cylindrical surface of first sheath 16.

Because wire strands 12 are circular in cross-section, spaces between adjacent wire strands 12 and center wire 14 are cumulatively identified as cable interior interstices 20. As shown in FIG. 1, annulus 18 and interstices 20 are filled with corrosion resistant material 22. Grease or another suitable material can be used for corrosion resistant material 22 to eliminate air pockets and to resist water intrusion into contact with wire strands 22. By filling annulus 18 with a lubricant or corrosion resistant material 22, the interior surface of first sheath 16 can be substantially cylindrical in one embodiment of the invention.

Figure 2:
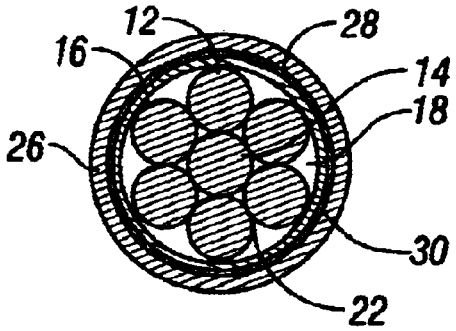
FIG. 2 illustrates a second sheath around the first sheath.
Figure 3:
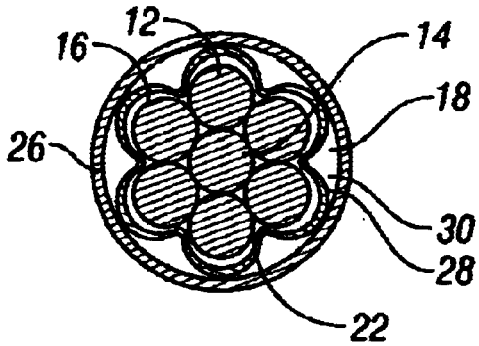
FIG. 3 illustrates a first sheath closely formed to the cable exterior surface.

FIGS. 2 and 3 illustrate second sheath 26 formed about first sheath 16. Annulus 28 is formed between second sheath 26 and first sheath 16 and is filled with a lubricant 30 to facilitate sliding movement therebetween. Lubricant 30 can comprise a corrosion resistant material similar to material 22. Grease or another lubricant is place on the outer surface of the seven strand wire tendon adjacent to the elastomeric sheath to resist corrosion created by air and water infiltration between the tendon and the sheath. In FIG. 2 annulus 28 is substantially cylindrical. In FIG. 3 first sheath 16 is tightly formed about the exterior surface of tendon 10 and helical grooves, filled with corrosion resistant material, are formed in the exterior surface of first sheath 16. This feature preferably uses a material for first sheath 16 having a thickness less than ten mils. Conventional membranes are typically twenty-five mils thick for regular systems and forty mils thick for high corrosion resistant, encapsulated systems. By providing a slim first sheath 16 about tendon 10 which is capable of fitting tightly about tendon 10 to create grooves in the exterior surface of first sheath 16, corrosion resistant material 30 can be stored in annulus 28 to resist intrusion by water of other contamination into contact with first sheath 16 or tendon 10.

Figure 4:
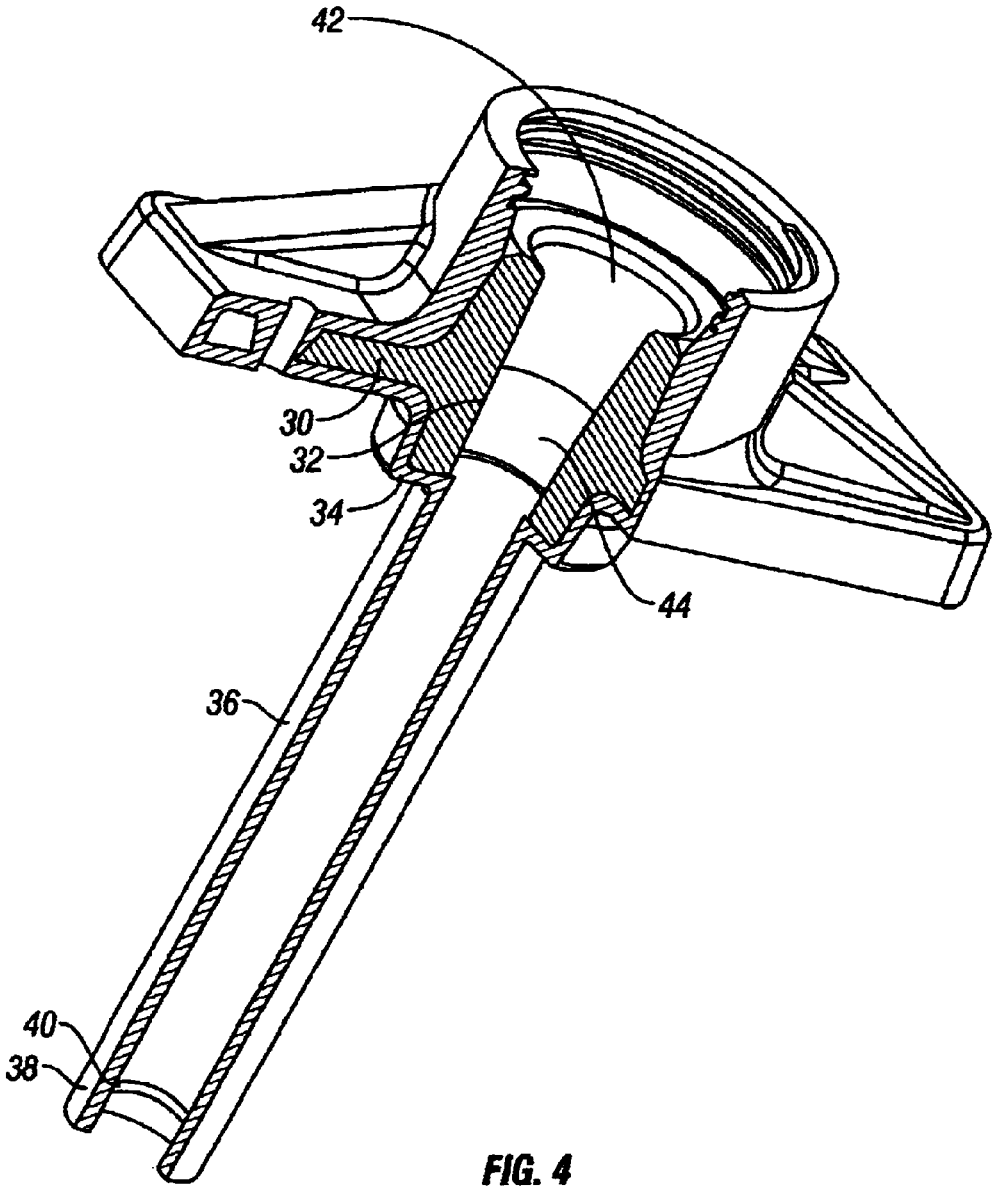
FIG. 4 illustrates a sectional view of an anchor base.

FIG. 4 illustrates a post-tension anchor comprising base 30 with shaped aperture 32. Base 30 can be formed with a cast metal material suitable for handling large compressive loads exerted by slips and other fastening devices. Base 30 includes sheath 34 and cylindrical extension 36 having a contact end 38 distal from base 30. Contact end 38 is preferably at least four inches distal from base 30, however shorter or longer lengths are possible to satisfy the objectives of the invention.

The inner surface of contact end 38 is preferably circular in cross-section for contacting the exterior surface of tendon 10 as tendon 10 is inserted through cylindrical extension 36 and base aperture 32. Seal 40 can be positioned between contact end 38 and tendon 10 to restrict liquid intrusion into the inside of cylindrical extension 36. Other fastening techniques such as tape, tie wire, or other devices may be attached to bind extension 36 to the exterior surface of tendon 10. This feature of the invention provides the advantage of providing a seal between sheath 34 and the exterior surface of tendon 10 at a distance away from the connection between the metal portion of base 30 and slips engaging tendon 10 as described below. By locating such seal away from the connection between tendon 10 and the slips, a buffer zone resistant to fluid intrusion is created.

Figure 5:
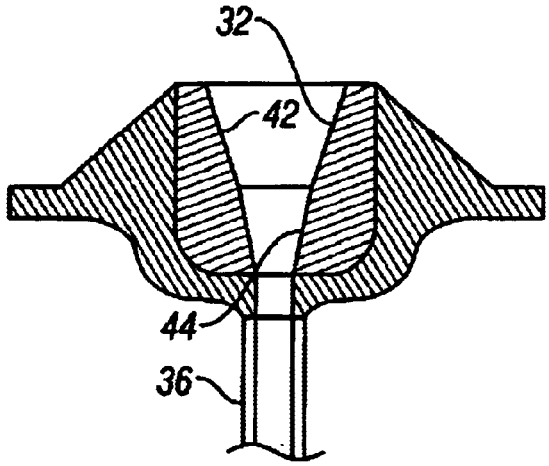
FIG. 5 illustrates a shaped aperture having two different surfaces.

As shown in FIG. 5, shaped aperture 32 can comprise an aperture having a compound surface having at least two different surfaces at different angles from the longitudinal axis. The longitudinal axis of aperture 32 is referred to herein as "centerline", however such centerline does not necessarily extend through the center of aperture 32. The larger opening is shown as a truncated conical surface 42 seven degrees from such axis which is the standard configuration used in the industry for wedges. The smaller opening is formed as a truncated conical surface 44 at a smaller angle from such axis. For example, the angle of surface 44 from the centerline can be two degrees, five degrees, or other angle inbetween. This configuration uniquely permits a larger aperture size to manipulate tendon 10 while limiting the aperture size through base 30 at the smallest possible aperture opening for insertion of tendon 10 therethrough. Additionally, such angle facilitates mold castings and permits the use of a larger aperture through base 30, thereby providing many other advantages described.

If base 30 had a single interior surface at a seven degree angle extending between first and second sides of anchor base 30, then the smaller aperture at first side would be of a particular dimension. By adding second surface at a different angle as illustrated in FIG. 5, the engagement with a wedge is facilitated while increasing the aperture diameter at the first side of anchor base 30. The first and second surfaces of such aperture through base 30 are continuously increasing in size as tendon 10 is inserted through anchor base 30 from the first side to the second side, thereby preventing the formation of shelves or obstructions which might encumber the passage of tendon 10. Although two surfaces are illustrated in FIG. 5, it would be possible to have more than two surfaces, and the shape of each surface can be formed as a truncated cone or irregular or other shape depending on the manufacturing and operational requirements.

Figure 6:
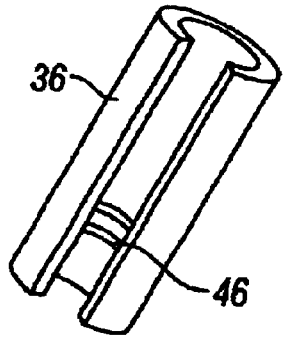
FIG. 6 illustrates rings for contacting a tendon.
Figure 7:
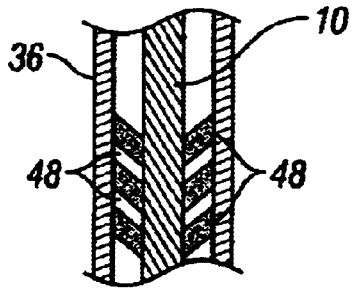
FIG. 7 illustrates contact rings oriented in a selected direction.

FIG. 6 illustrates another form of seal wherein contact end 38 includes one or more rings 46 for contacting the exterior surface of tendon 10 and for providing a liquid tight engagement therebetween. Rings 46 can comprise a molded feature on an inner surface of cylindrical extension or can comprise a separate component assembled with contact end 38. Rings 46 can comprise a simple ring feature or can comprise a compound shape. In another embodiment such as shown in FIG. 7, one or more rings 48 can be angled in a selected direction to facilitate insertion of tendon 10 therethrough while resisting withdrawal of tendon 10 from such engagement.

By integrally molding extension 36 into base 30 and by reducing the size of shaped aperture 32, void spaces within the anchor interior are substantially eliminated. An integral extension 36 reduces increases the zone of encapsulation proximate to engagement between slips and tendon 10, thereby reducing the possibility of fluid intrusion into contact with exposed wire strands 12. Even more importantly, extension 36 provides an integral seal connection between base 30 and the exterior surface of tendon 10. Extension 36 also permits such point of connection to be distal from base 30, thereby providing potential gripping strength over a larger surface area than is possible within the relatively small surface area provided by base 30.

The method of the invention comprises the steps of positioning an anchor base in a selected location, wherein the anchor base has a shaped aperture for permitting insertion of the tendon therethrough and further has a sheath comprising a cylindrical extension having a contact end distal from the anchor base for contacting the tendon as the tendon is inserted through the cylindrical extension, of inserting an end of the tendon through the cylindrical extension distal end so that the distal end contacts the tendon, and of threading the tendon end through the anchor base aperture until a selected length of the tendon extends through the anchor base.

The invention provides superior anti-corrosion protection through the entire tendon length, and especially around the point of engagement with post-tension anchors. By providing a first sheath within a second sheath, the invention uniquely furnishes protection against tendon scarring and resulting water intrusion. By uniquely providing for a dual sheath system about the internal tendon, the sheath materials can be selected from material classes such as nylon, polymers, metals, or other organic or inorganic or mineral or synthetic materials. The outer second sheath can be formed with a tough material resistant to punctures and stretching damage, while the interior first sheath can be formed with another material for retaining the corrosion resistant material.

In other embodiments of the method, a selected section of the sheath can be removed from the tendon to expose the tendon inner wire strands at a location proximate to said anchor base shaped aperture. In other steps, the tendon can be tensioned to a selected degree and a wedge can be engaged between said exposed wire strands and said anchor base shaped aperture to lock the relative position therebetween. In a preferred embodiment of the invention, the selected sheath section is removed after the tendon is tensioned to a selected degree. Corrosion resistant material such as grease or other compound can be inserted into the anchor base cylindrical extension either before or after the tendon is inserted therethrough.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An anchor for engagement with a post-tension tendon, comprising:

an anchor base having first and second sides and an aperture for receiving a post tension anchor therethrough, the aperture having a tapered interior surface for receiving tension retaining wedges therein, the taper narrowing in a direction toward the seocn side;

a encapsulating jacket surrounding the anchor base, the jacket having openings corresponding to openings in the aperture on the first and second side, the jacket having a substantially cylindrical extension formed integrally therewith and having an en distal from the second side of the anchor base for engaging an outer surface of the tendon, the extension having an integrally formed seal on an interior surface of the contact end.

2. The anchor of claim 1 wherein the tapered interior surface comprises a single taper angle.

3. The anchor of claim 2 wherein the tapered interior surface comprises at least two different taper angles.

4. The anchor of claim 2 wherein the seal includes a plurality of separately formed individual seal rings on the interior surface of the extension.

5. The anchor of claim 2 wherein the seal includes a single ring formed on the interior surface of the extension.

6. The anchor of claim 2 wherein the extension includes a corrosion resistant material therein.

7. The anchor of claim 2 wherein the extension is at least about four inches in length from the second side of the anchor base.

* * * * *